United States Patent [19]

Herwig

[11] Patent Number: 4,834,460

[45] Date of Patent: May 30, 1989

[54] BABY SEAT RESTRAINT

[76] Inventor: Lizabeth Herwig, 4382 Skylark La., Greendale, Wis. 53129

[21] Appl. No.: 99,151

[22] Filed: Sep. 21, 1987

[51] Int. Cl.[4] ..... A62B 35/00; B60R 21/10

[52] U.S. Cl. ..... 297/485; 297/467; 297/468

[58] Field of Search ..... 297/464, 465, 467, 468, 297/485, 482, 484; 2/338

[56] References Cited

U.S. PATENT DOCUMENTS

| | | | |
|---|---|---|---|
| 1,823,318 | 9/1931 | Dick | 297/464 X |
| 2,396,329 | 3/1946 | Lippmann | 2/338 |
| 2,413,395 | 12/1946 | Ware | 297/484 X |
| 2,602,932 | 7/1952 | Eaton | 2/338 |
| 2,741,412 | 4/1956 | Hinkle | 297/467 |
| 3,090,048 | 5/1963 | Loew | 2/338 |
| 3,155,986 | 11/1964 | Miller | 2/338 X |
| 3,321,247 | 5/1967 | Dillender | 297/484 X |
| 4,637,629 | 1/1987 | Cummings | 297/464 X |

FOREIGN PATENT DOCUMENTS

| | | | |
|---|---|---|---|
| 255971 | 5/1963 | Australia | 297/468 |
| 1158617 | 12/1983 | Canada | 297/468 |
| 3019378 | 11/1981 | Fed. Rep. of Germany | 297/482 |

*Primary Examiner*—Peter R. Brown

*Attorney, Agent, or Firm*—Ronald E. Barry

[57] ABSTRACT

An infant/child chair restraint including a chair panel of flexible fabric material having hook-and-loop fastening strips at the ends of the panel for adjustably mounting the panel on the back of a chair, a child panel of flexible fabric material having a strip of stiffening material therein and having hook-and-loop fastening strips at the end for adjustably mounting the panel on the body of a child, the chair panel and child panel being connected at their midpoints, and a crotch panel having one end connected to the midpoint of the chair and child panels and having an adjustable loop at the other end for connecting the crotch panel to the child panel.

2 Claims, 1 Drawing Sheet

BABY SEAT RESTRAINT

BACKGROUND OF THE INVENTION

This invention relates to a restraining apparatus to support an infant or child in a sitting position in a chair or seat.

Typically restraints for infants and children in high-chairs or seats have consisted of a band which encircles the waist of the child or infant as well as the vertical section, or back, of the chair or seat. The child, and particularly if the child is an infant, has a tendency to slide down in the chair or to lean sideways in a chair due to the lack of lateral support by a single band. These restraining devices often are of fixed length with limited adjustments (snaps) and, therefore, are not readily adaptable to accomodate both infants and children of different sizes and various chair sizes.

SUMMARY OF THE INVENTION

The restraining apparatus according to the present invention provides for the separate attachment of the apparatus to the back of the chair and to the body of the infant or child. Both attachments being adjustable to accomodate both various size chairs and various size infants. A crotch strap is also provided on the body panel or strap which can be readily adjusted for different size infants.

A principal feature of the invention is the provision of a unitary or one piece restraining apparatus which is readily adjustable to accomodate various size chair backs, and various size children. This construction is simpler, light weight and more compact than known constructions and provides a more effective support for the child in an upright position in a chair.

Another feature of the invention is the provision of a reinforcing strip mounted inside the body strap to prevent wadding of the body strap around the body of the child.

Another feature of the invention is the ability to store the apparatus because of the flexible fabric used to form the panels and straps.

Other principal features and advantages of the invention will become apparent to those skilled in the art upon review of the following detailed description, claims and drawings.

Figure 1:
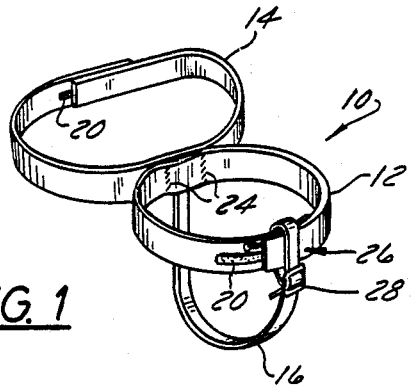
FIG. 1 is a perspective view of the restraining apparatus according to the invention.
Figure 2:
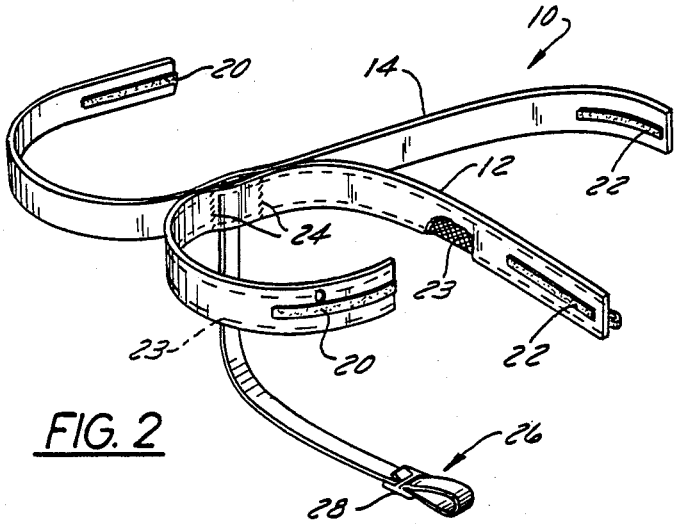
FIG. 2 is a perspective view of the restraining apparatus showing the adjustable connections of the chair strap, body strap and crotch strap.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Figure 3:
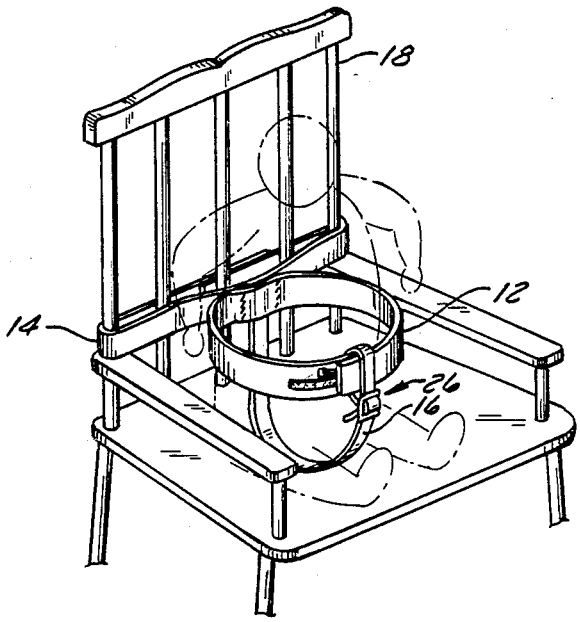
FIG. 3 is a perspective view showing the restraining apparatus mounted in a chair and supporting an infant.

As shown in the drawings, the restraining apparatus 10 includes a body panel or strap 12, a chair panel or strap 14 and a crotch strap 16. The body strap 12 is designed to adjustably support the body of an infant or child as seen in FIG. 3. The chair strap 14 is designed to adjustably fit on the vertical section or back 18 of a chair to hold the child in an upright position. The crotch strap 16 is connected to the body strap 12 and chair strap 14 at one end and passes underneath the child and is adjustably connected to the body strap 12 in the front of the child. The panels or straps 12, 14 and 16 can be formed of various flexible fabric materials such as quilted fabric material having a fiber content of 65% polyester and 35% cotton with a nylon tricot backing.

Means are provided for adjustably connecting the ends of the body strap 12 and the chair strap 14. Such means is the form of hook and loop fastening strips 20 provided on the outside of one end of each of the straps 12 and 14 and hook and loop fastening strips 22 provided on the inside of the other end of each of the straps 12 and 14. The hook-and-loop fastening strips, as is generally understood, can be overlapped to tightly engage both of the body of the child and the back of the chair. Although hook and loop fastening strips have been disclosed herein it is within the contemplation of the invention that various other means may be used to provide an adjustable connection for both the chair straps and the body strap. In this regard it is of particular importance to use an adjustable connection such as a clasp and ring, buckle or snap that cannot be readily opened by a child. This is particularly important with respect to the body strap which can be readily reached by the child or infant.

The body strap 12 and chair strap 14 are connected at their midpoints by stitching 24. The crotch strap 16 is connected at one end to the body strap and chair strap by means of the stiching 24 at the midpoint connection and is provided with a loop type adjustable connection 26 at the other end. In this regard the loop type connection 26 includes a slideable buckle 28 which is attached to the end of the strap and is moveable along the strap to adjust the length of the crotch strap. As seen in FIG. 3 the loop 26 encircles the ends of the body strap in the front of the child. The body strap is wrapped around the body of the child and connected at the ends so that the strap is snug with respect to the body of the child. The crotch strap can also be passed underneath the child and adjusted to provide a snug connection. With this arrangement the child cannot fall over laterally within the body strap and is thereby firmly supported on the back of the chair.

Means can be provided for stiffening the body strap so that it does not collapse around the body of the infant. Such means can be in the form of a strip of plastic canvas mesh 23 which is sewn inside the full length of the body strap.

The embodiments of the invention in which an exclusive property or privelege is claimed or defined as follows:

1. A child restraining apparatus comprising a first panel of sufficient length to encircle the back of a chair with the ends of said panel overlapping in the back of the chair, a second panel of sufficient length to encircle the body of a child/infant with the ends of said second panel overlapping in the front of the child, a strip of plastic canvas mesh in said second panel for stiffening said second panel, said first and second panels being connected at their midpoints, a third panel having one end joined to the midpoints of said first and second panels, hook and loop fastening means on said ends of said first panel for adjustably mounting said first panel on the back of a chair, a hook mounted on one end of said second panel and a ring mounted on the other end of said second panel for mounting said second panel around the body of a child, and means on the other end of said third panel for adjustably connecting said third panel to said second panel at the front of the child.

2. An infant/child chair restraint comprising a first panel having a midpoint and a pair of ends, said first panel being formed of a flexible material and adapted to be mounted on the back of a chair, hook and loop fastening means mounted on the ends of said first panel for adjustably connecting said first panel at the back of a chair back, a second panel having a midpoint and a pair of ends, said second panel being formed of a flexible fabric material and adapted to be mounted on the body of an infant/child, a strip of plastic canvas mesh in said second panel to stiffen said flexible fabric material, means mounted on said second panel for adjustably connecting said second panel around the waist of the infant/child, said connecting means on said second panel, comprising hook and loop fastening means, means for connecting said first and second panels at their midpoints, a third panel having one end connected to the midpoint of said first and second panels, and adjustable means mounted on the other end of said third panel for connecting said third panel to said second panel.

* * * * *